US005650588A

United States Patent [19]

Nakajima

[11] Patent Number: 5,650,588

[45] Date of Patent: Jul. 22, 1997

[54] METHOD FOR SETTING BLASTING EMPLOYING BAR-LIKE CHARGE

[76] Inventor: Yasuji Nakajima, 7-13, Morinosato 4-chome, Atsugi 243-01, Japan

[21] Appl. No.: 639,723

[22] Filed: Apr. 29, 1996

[30] Foreign Application Priority Data

Oct. 10, 1995 [JP] Japan ..... 7-297333

[51] Int. Cl.[6] ..... F42B 3/00

[52] U.S. Cl. ..... 102/301; 102/302; 102/312

[58] Field of Search ..... 102/301, 302, 102/312

[56] References Cited

U.S. PATENT DOCUMENTS

| | | | |
|---|---|---|---|
| 3,735,704 | 5/1973 | Livingston | 102/23 |
| 3,804,017 | 4/1974 | Venable et al. | 102/23 |
| 4,273,049 | 6/1981 | Edwards et al. | 102/312 |
| 5,375,527 | 12/1994 | Nakajima . | |
| 5,386,778 | 2/1995 | Sullivan, Jr. | 102/302 |

OTHER PUBLICATIONS

"Explosive Safety Text Series 17, Application of Explosive in Occasions" edited by Ministry of International Trade and Industry, Ground Emission Division, published by Shadan Hojin Zenkoku Kayakurui Hoan Kyokai, Jan., 1991, p. 24.

"New Technology of Explosive" edited by R. Gusterferson, published by Morikita Shuppan Kabushiki Kaisha, Apr. 10, 1981, p. 60.

*Primary Examiner*—Peter A. Nelson

*Attorney, Agent, or Firm*—Trexler, Bushnell, Giangiorgi & Blackstone, Ltd.

[57] ABSTRACT

This invention is to provide a setting method of blasting in bar-like charge which is reasonable to achieve both of safety and maximum blasting or fracturing efficiency, and to provide the method which can be setting accurately a charge hole diameter d relative to the other facters.

A safety charge amount L is derived by controlling a nominal total fracture rock volume V, namely, a filler length $P^2 \times a$ charge hole length M, with an inclination coefficient $\sin^3\alpha \times a$ blasting coefficient c.

A charge hole diameter d is derived by the fact that the $(\sin^3\alpha \cdot c \cdot P^2 \cdot M)$ is equal to a $((\pi/4)d^2(M-P))$ which applies the expression for deriving a volume of a circular column.

11 Claims, 8 Drawing Sheets

METHOD FOR SETTING BLASTING EMPLOYING BAR-LIKE CHARGE

BACKGROUND OF THE INVENTION

1. Field of the Invention

The present invention relates generally to a setting method for blasting in a bar-like charge for blasting ground or rock employing an explosive. More specifically, the invention relates to a setting method for blasting in a bar-like charge system having a predetermined blast hole angle α, a predetermined blast hole length M, a predetermined blast hole diameter d, a charge length N and a filler length P with respect to a free surface GL of said ground or the rock, instead of a single point concentrated charge system.

2. Description of the Related Art

Conventionally, land cultivation has been normally performed for undeveloped moor and forest and so forth, it has not caused serious problems by merely considering efficiency of blasting with paying attention for avoidance of accident associated with blasting, such as damaging by flying rock and so forth.

However, in the recent years, due to increasing of population on the earth, it is increasing a chance to perform blasting in the area close to the human resident area or in the city. Associating with this, the conventional blasting method merely seeking for efficiency of blasting should cause damaging of the human body and of other constructions, such as neighbourhood houses, buildings and so forth by flying rock and so forth, inherently.

For assuring security with avoiding flying rock accident, it is given importance for reducing amount of an explosive. However, when amount of the explosive is reduced absurdly, efficiency of blasting is inherently lowered unacceptably to border progree of constructional work. Accordingly, it is desired to use the maximum amount of explosive in a range where flying rock will not be caused in the free surface to achieve both of the security and efficiency, in blasting operation.

In such circumstance, as a method for setting blasting in consideration of both of security and efficiency, Hauser's equation has been known. Hauser's equation is directed to a single point concentrated charging and establishes the following equation for achieving both of the security and efficiency:

$$L=c\times W^3 \tag{10}$$

wherein c is a blasting coefficient in a range of 0.25 to 0.45 and W is the least resistance length.

Studying the Houser's equation, assuming that the breaking radius D on the free surface is equal to the least resistance length W, i.e. when W=D, the volume of the rock to be broken by the explosive is in a reversed cone shaped configuration, from a volume of cone, the volume Vb of the rock to be broken into the reversed cone shaped configuration is expressed by:

$$Vb=W^3$$

Accordingly, the foregoing equation (10) can be modified as:

$$L=c\times Vb \tag{10a}$$

The relational expression of L=c×Vb means that, in order to make the value of L within the safe range, the charge amount L is to be determined at a value to be safe within a range of blasting coefficient c=0.25 to 0.45 of the fracture volume Vb of the rock to be broken at the charge amount.

However, the Houser equation is directed to the single point concentrated charge system. Namely, without considering the volume of the charge amount as solid, the system considers that volume is charged at a single point concentrate manner.

In the practical blasting operation, the bar-like charge system is taken to charge the explosive within a pit or hole having a certain length H and a diameter d. Therefore, the explosive is present as a solid having a certain length (charge length (H−W) and the diameter d, wherein W is the least resistance length.

Accordingly, when the charge amount L required for blasting in the bar-like charging is derived employing the Houser's equation, a value far different from practical amount may be derived to cause significant danger. For example, when blasting of the rock is to be performed employing a dynamite having a diameter of explosive of 25 mm charged in a hole diameter d=25 mm, the charge amount L derived by the Houser's equation becomes:

$$L=cW^3=0.25\times 2^3=2 \quad (kg)$$

assuming the blasting coefficient c=0.25 and the least resistance length W=2 m. This charge amount corresponds to a twenty of dynamites having explosive diameter of 25 mm, explosive length of 165 mm and weight of 100 g. When, these dynamites are charged in the 2 m of charge hole, the hole will be filled with 12.5 in number of the dynamites. Therefore, 7.5 in charge of dynamites cannot be charged in the charge hole. Therefore, in order to maintain the calculated charge amount, the diameter of the charging hole should be made greater to be 80 to 100, or more. However, the hole diameter d cannot be derived through the Houser's equation.

In the blasting operation in the bar-like charge, in practice, the modified Houser's equation $L=cW^3$ is employed. Namely, with replacing $W^3$ with DWH, the Houser's equation can be re-written as:

$$L=cDWH \tag{11}$$

wherein c: blasting coefficient;

D: fracture radius in the free plain;

W: least resistance length; and

H: is a charge hole length

Here, it is quite dangerous to set the fracture radius D and the least resistance length W without establishing balance, in view of security. Therefore, it is required to establish a relationship where $$W=D \text{ or } W\doteq D \tag{12}$$

is satisfied.

However, even when the foregoing equations (11) and (12) are employed, it is still irrelative to the charge hole diameter d. Therefore, it is not possible to accurately determined the charge hole diameter d in relation to other element.

In this respect to this, the charge hole diameter d is typically experimentarily taught to be at 1/45 of the least resistance length W (see R. Gusteferson: "New Blasting Technology", Morikita Shuppan K. K., Apr. 10, 1981, Page 60). Also, Japan Industrial Explosive Association utilizes similar standard but widening allowable range to provide a guideline "In case of typical blasting, the least resistance length is within a range of 30 times to 60 times of the charge hole diameter". In other words, "the charge hole diameter d is 1/30 to 1/60 of the least resistance length" (see Ground Emission Division of Ministry of International Trade and Industry of Japan, "Explosive Safety Text Series 17", January, 1991, Page 24). In concrete example of this relationship, when the charge hole diameter is set at 3 cm, the least resistance length W can be within a range of 90 cm to 180 cm. Such range is too wide in view of criticalness of the least resistance length for possibility of occurrence of accident on the human being, and thus is dangerous.

The reason is that the least resistance length W in the blasting operation is a value representative of the shortest distance to the upper end of the explosive to the surface of the earth. When the value of the least resistance length is too short, accident due to flying rock may be caused. On the other hand, when the value of least resistance length is too long, fracture at the surface of the earth becomes insufficient to lower efficiency of operation. Therefore, as can be appreciated, the least resistance length W is quite important factor in determining the safety and efficiency in the blasting operation.

Here, a number of accident by blasts for construction works in Japan from 1979 to 1989 are counted 261, in which accident by flying rock are counted 160 cases, which are 61.3%.

SUMMARY OF THE INVENTION

In view of the drawbacks in the prior art as set forth above, it is the first object of the present invention to provide a setting method for blasting in bar-like charge which is reasonable to achieve both of safety with avoiding possibility of occurrence of accident due to flying rock and maximum blasting or fracturing efficiency, in connection with the setting method of blasting in bar-like charge, for which no reliable theory has not been established and setting method for blasting in the single point concentrated charge system has been employed with modification in the prior art.

The second object of the present invention is to provide a setting method of blasting in bar-like charge, in which variation of destruction force to be exerted on the free surface GL due to inclination angle of the charge hole of $\alpha \leqq 90°$ specific to individual bar-like charge, as inclination coefficient and a safety charge amount of an explosive is determined with taking the inclination coefficient into account.

The third object of the present invention is to provide a setting method of blasting in bar-like charge, in which a charge hole diameter d that cannot be derived from known relational expression in the prior art, can be accurately set in relation to other factors, such as charge hole length M a least resistance W, a filler length P, a charge length N (M−P), a charge amount L, a blasting coefficient c, a fracture radius or interval length D with establishing association by a common relational expression.

In order to accomplish the above-mentioned first and second objects, a method for setting blasting with bar-like charge, for which excavate a charge hole into ground from a free surface GL thereof, in accordance with the first aspect of the invention, comprises the steps of:

deriving a fracture rock volume $V_1=W^3$ in a range influencing for flying rock on the free surface GL with taking a charge hole angle relative to the free surface GL in excavation of the charge hole from the free surface GL as $\alpha$, a charge hole length as M, a charge length as N=M−P, a filler length as P, with taking a least resistance length W as shortest distance between the upper end of the charge length N and the free surface GL, making a fracture radius D caused on the free surface equal to the least resistance length W, and on the basis of the least resistance length W and the fracture length D=W;

deriving a nominal fracture rock volume $V_2=P^3$ on the basis of the filler length P and a nominal fracture radius E equal to the filler length P, i.e. E=P;

deriving an inclination coefficient $\sin^3\alpha$ $(=V_1/V_2=W^3/P^3)$ based on a ratio between the fracture rock volume $V_1=W^3$ and the nominal fracture rock volume $V_2=P^3$; and deriving a safety charge amount L by controlling a nominal total fracture rock volume $V=P^2 \cdot M$ with the inclination coefficient $\sin^3\alpha$ and a blasting coefficient c=0.2 to 0.5, by one of $$L=\sin^3\alpha \cdot c \cdot V \quad (1)$$

$$L=\sin^3\alpha \cdot c \cdot P^2 \cdot M \quad (1a)$$

$$L=(W^3/P^3) \cdot c \cdot V \quad (1b)$$

$$L=(W^3/P^3) \cdot c \cdot P^2 \cdot M \quad (1c).$$

In order to accomplish the foregoing first and second objects, a method for setting blasting with bar-like charge, for which excavate a charge hole to ground having two free surfaces, in which the other free surface GL2 being oriented at an inclination angle $\alpha$ relative to one free surface GL1, in accordance with the second aspect of the invention, comprises the steps of:

deriving a fracture rock volume $V_1=W^3$ in a range influencing for flying rock on the one free surface GL1 with taking the charge hole angle relative to the one free surface GL1 in excavation of the charge hole from the one free surface GL1 as $\alpha$, a charge hole length as M, a charge length as N=M−P, a filler length as P, with taking a least resistance length W as shortest distance between the upper end of the charge length N and the one free surface GL1, making a fracture radius D between the other free surface GL2 and the charge hole equal to the least resistance length W, and on the basis of the least resistance length W and the fracture length D=W;

deriving a nominal fracture rock volume $V_2=P^3$ on the basis of the filler length P and a nominal fracture radius E equal to the filler length P, i.e. E=P;

deriving an inclination coefficient $\sin^3\alpha$ $(=V_1/V_2=W^3/P^3)$ based on a ratio between the fracture rock volume $V_1=W^3$ and the nominal fracture rock volume $V_2=P^3$; and deriving a safety charge amount L by controlling a nominal total fracture rock volume $V=P^2 \cdot M$ with the inclination coefficient $\sin^3\alpha$ and a blasting coefficient c=0.2 to 0.5, by one of $$L=\sin^3\alpha \cdot c \cdot V \quad (1)$$

$$L=\sin^3\alpha \cdot c \cdot P^2 \cdot M \quad (1a)$$

$$L=(W^3/P^3) \cdot c \cdot V \quad (1b)$$

$$L=(W^3/P^3) \cdot c \cdot P^2 \cdot M \quad (1c).$$

In the preferred method, the inclination coefficient $\sin^3\alpha$ may be a ratio of actual total fracture rock volume $Va=\sin^3\alpha\cdot P^2\cdot M$ and a nominal total fracture rock volume $V=P^2\cdot M$, namely $Va/V=\sin^3\alpha$.

In the present invention, when charge hole angle $\alpha$ relative to the free surface GL of the charge hole excavated from the free surface GL being 90°, the safety charge amount L may be set by $$L=c\cdot P^2\cdot M \tag{1bb}$$

or, when the $\alpha$ is 90°, a vertical length H from the lower end of the charge length N to the free surface GL is equal to the charge hole length M, and the filler length P and the least resistance length W are equal to each other, the safety charge amount L may be set $$L=c\cdot W^2\cdot H \tag{1bbb}$$

When the one free surface GL1 and the other free surface GL2 are present, the charge hole is excavated from the one free surface GL1, and when a nominal length E from the other free surface GL2 and the filler length P is P<E, the blasting may become a configuration of one free surface blasting having the least resistance length W relative to the one free surface GL1.

On the other hand, when the one free surface GL1 and the other free surface GL2 are present, the charge hole is excavated from the one free surface GL1, and when a nominal length E from the other free surface GL2 and the filler length P is P>E, the blasting may become a configuration of one free surface blasting having the least resistance length W relative to the one free surface GL2.

In order to enable setting the charge hole diameter as the foregoing third object of the present invention, utilizing an equation for deriving a volume of a cylinder in consideration of the fact that the charge amount L in bar-like charge is an amount corresponding to a volume of a circular column based on the charge hole diameter d and the charge length N=M−P for establishing setting with combining the charge hole diameter d which is inherent factor in bar-like charge with other factors, the charge amount L is derived by:

$$L=(\pi/4)d^2(M-P)\cdot A \tag{2}$$

wherein A is a specific wave of a charged explosive, and by coupling the relational expression with the equations for deriving the safety charge amount of $$L=\sin^3\alpha\cdot c\cdot V \tag{1}$$

$$L=\sin^3\alpha\cdot c\cdot P^2\cdot M \tag{1a}$$

$$L=(W^3/P^3)\cdot c\cdot V \tag{1b}$$

$$L=(W^3/P^3)\cdot c\cdot P^2\cdot M \tag{1c}$$

to establish $$\sin^3\alpha\cdot c\cdot V=(\pi/4)d^2(M-P)A \tag{3}$$

$$\sin^3\alpha\cdot c\cdot P^2\cdot M=(\pi/4)d^2(M-P)A \tag{3a}$$

$$(W^3/P^3)\cdot c\cdot V=(\pi/4)d^2(M-P)A \tag{3b}$$

$$(W^3/P^3)\cdot c\cdot P^2\cdot M=(\pi/4)d^2(M-P)A \tag{3c}$$

The charge hole diameter may be derived from the equation (3a) as $$d=\sqrt{((4\sin^3\alpha\cdot c\cdot P^2\cdot M)/(\pi(M-P)A))} \tag{4}$$

or by replacing the (1a) in the equation (4) as $$d=\sqrt{((4L)/(\pi(M-P)A))}\ . \tag{4a}$$

The filler length P may be derived from the following equations modified from (3a) or (3b) as:

$$P=\frac{-\frac{\pi}{4}d^2A+\sqrt{\left[\frac{\pi}{4}d^2A\right]^2+\pi d^2\cdot\sin^3\alpha\cdot c\cdot AM^2}}{2\sin^3\alpha\cdot c\cdot M} \tag{5}$$

or $$P=\frac{-\frac{\pi}{4}d^2A+\sqrt{\left[\frac{\pi}{4}d^2A\right]^2+\pi d^2\cdot\left(\frac{W^3}{P^3}\right)\cdot c\cdot AM^2}}{2\cdot\left(\frac{W^3}{P^3}\right)\cdot c\cdot M}\ . \tag{5a}$$

The charge length N=M−P may be xpressed from the foregoing (4):

$$N=(4\sin^3\alpha\cdot c\cdot P^2\cdot M)/(\pi d^2A) \tag{6}$$

or from the equation (4a), $$N=(4L)/(\pi d^2A) \tag{6a}$$

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
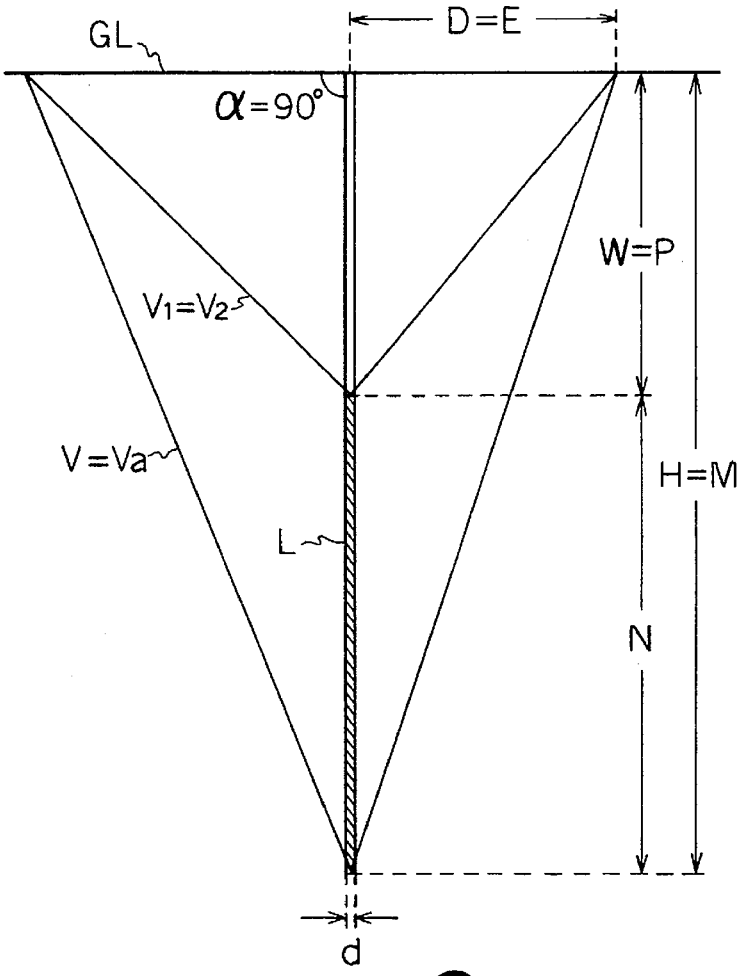
FIG. 1 is a explanatory sectional view showing relationship of various portions in blasting in bar-like charge with a charge hole angle $\alpha$=90° in one free surface GL.
Figure 2:
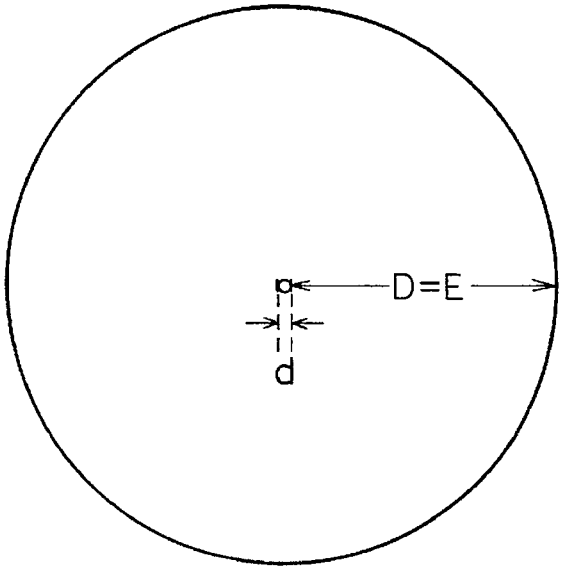
FIG. 2 is a plan view of FIG. 1.
Figure 3:
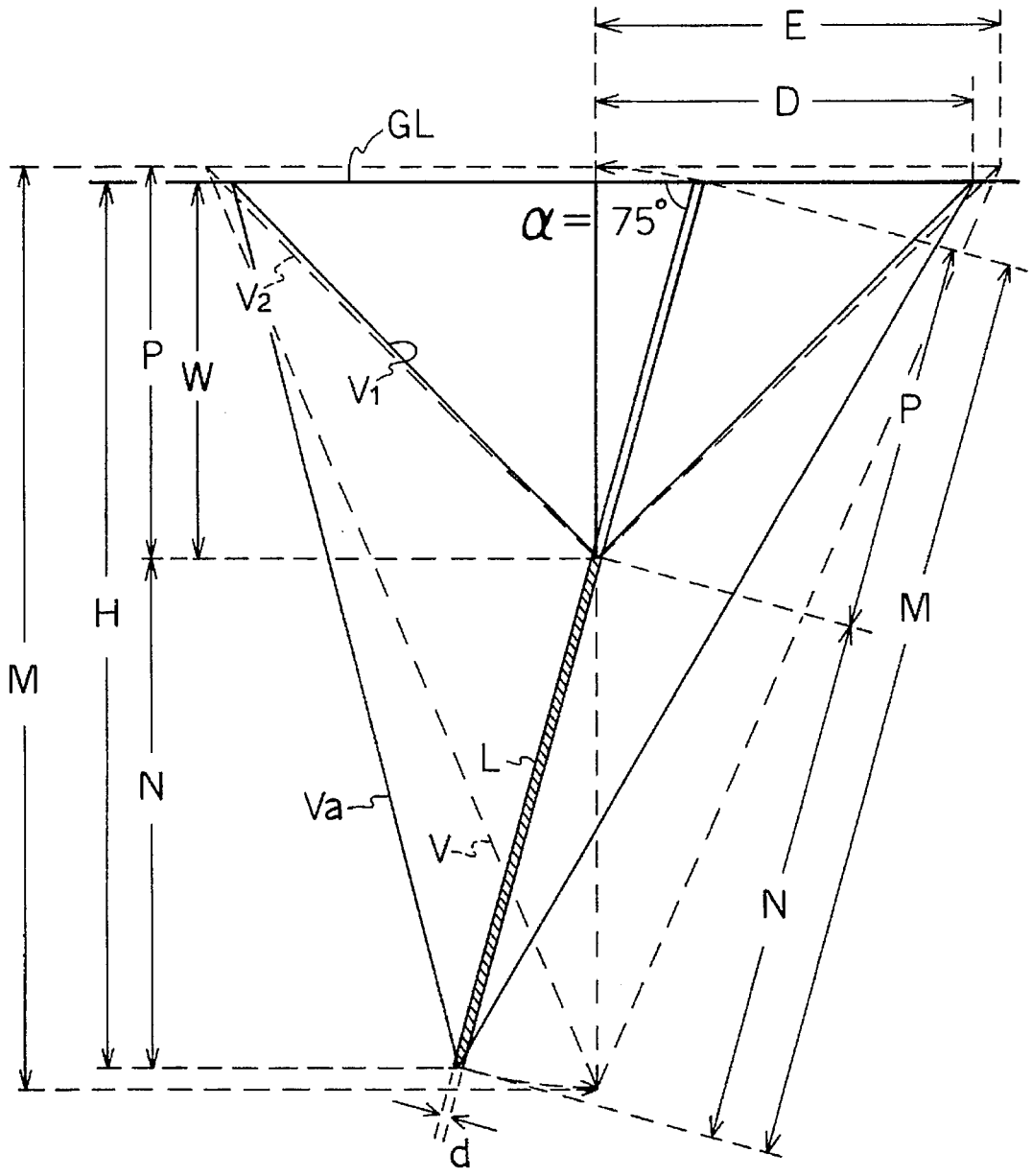
FIG. 3 is a explanatory longitudinal sectional view showing relationship of various portions in blasting in bar-like charge with a charge hole angle $\alpha$=75° with relation to one free surface GL.
Figure 4:
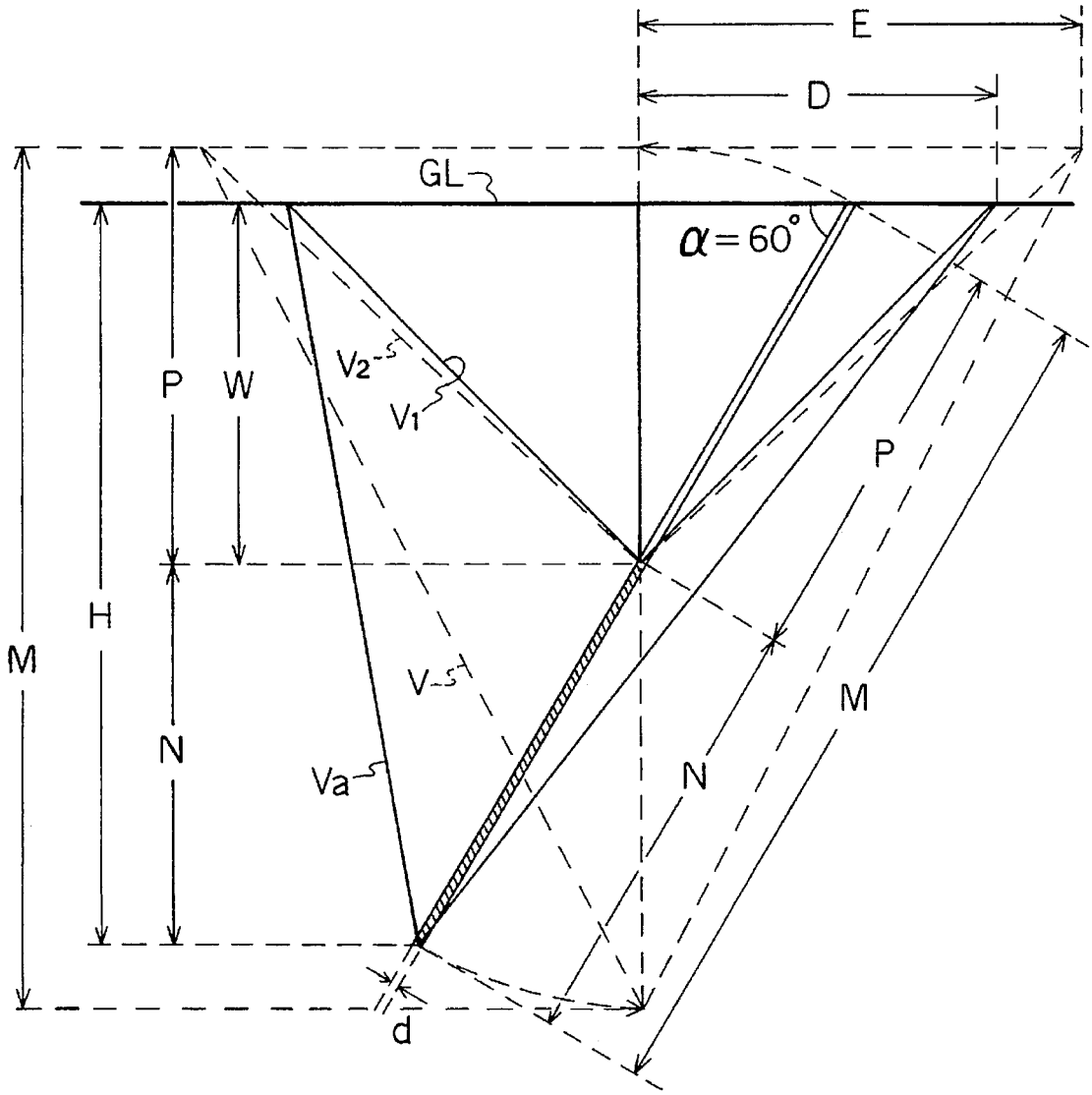
FIG. 4 is a explanatory sectional view showing relationship of various portions in blasting in bar-like charge with a charge hole angle $\alpha$=60° with relation to one free surface GL.
Figure 5:
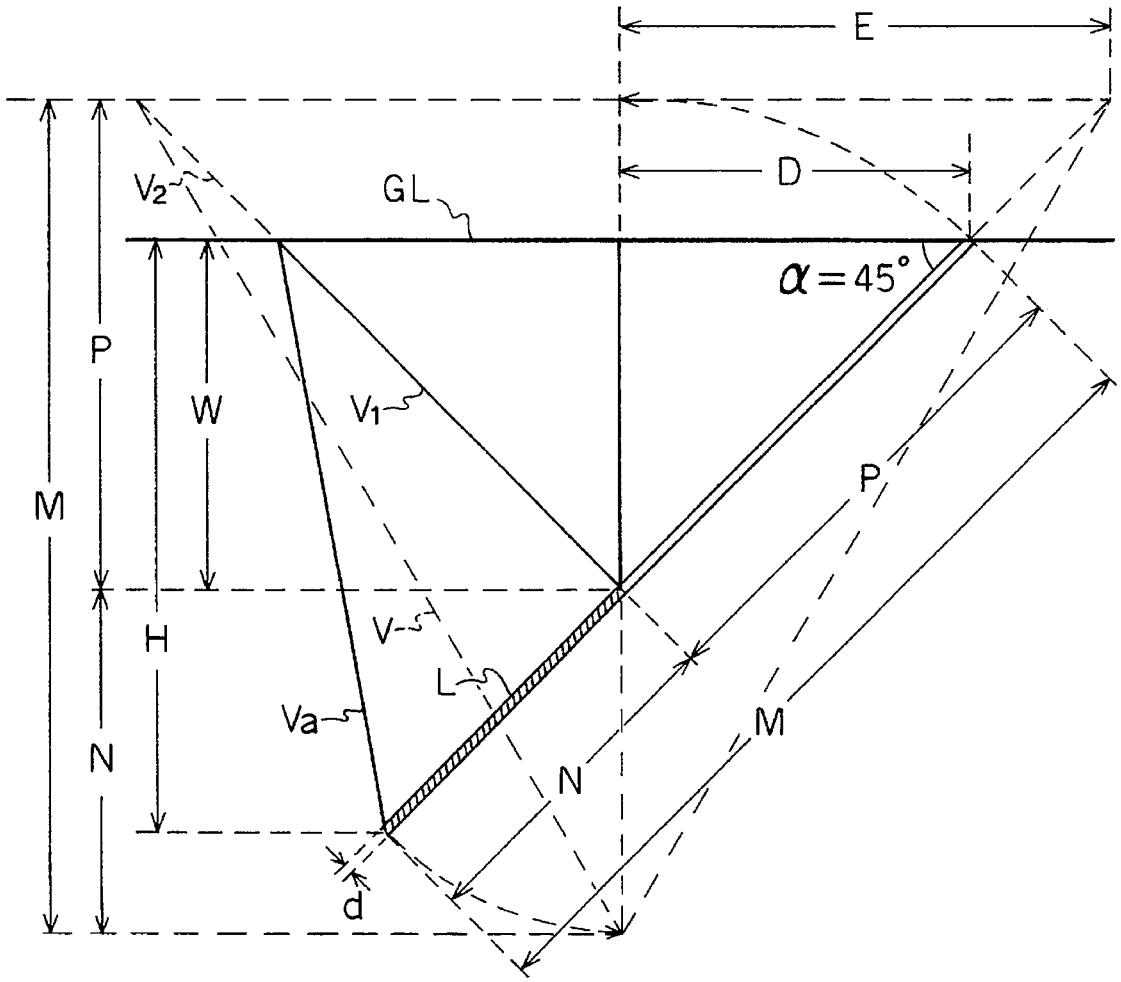
FIG. 5 is a explanatory sectional view showing relationship of various portions in blasting in bar-like charge with a charge hole angle $\alpha$=45° with relation to one free surface GL.

FIGS. 1 to 5 respectively illustrate setting method of blasting in bar-like charge with respect to one free surface GL. FIG. 1 is directed to a case of a charge hole angle $\alpha$ of 90° relative to a free surface GL, FIG. 3 is directed to the case where the angle $\alpha$ is set at 75°, FIG. 4 is directed to the case where the angle $\alpha$ is set at 60°, and FIG. 5 is directed to the case where the angle $\alpha$ is set at 45°. These figures shows variation of construction of respective portions due to difference of the charge hole angle or inclination angle $\alpha$.

In order to facilitate clear understanding of the present invention, a setting method of blasting in bar-like charge for one free surface GL in the case where the charge hole angle is 45° as illustrated in FIG. 5 will be discussed initially.

In FIG. 5, a charge hole for receiving a bar-like charge is inclined at an angle of 45° with respect to the free surface GL, and formed in a size having a charge hole length of M and a charge hole diameter d. Next, a charge amount L corresponding to the charge length N (M–P) from the bottom of the charge hole is charged. Then, in a space between the top end of the bar-like charge of the explosive and the free end GL, a filler is filled. The length of the filler is expressed by P. Accordingly, the overall charge hole length M is equal to a sum of the charge length N and the filler length P.

$$V1=W^3$$

is established under a condition of W=D.

Furthermore, attention should be paid for the fact that, since the charge hole angle $\alpha=45°$, the least resistance length W becomes shorter than the filler length P in the extent of:

$$W=\sin 45°\times P$$

This means that, assuming the least resistance length W and the filler length P are equal to each other at the charge hole angle $\alpha=90°$ (see FIG. 1), when the charge hole angle is $\alpha=45°$ as shown in FIG. 5, the least resistance length W is shortened to be shorter than the filler length P in the extent of sin 45°=0.7071, and thus danger for flying rock in the condition of FIG. 5 is increased from the condition of FIG. 1 in the corresponding extent.

Without recognition of danger as set forth above and in view of the fact that the least resistance length W=the filler length P can be established at the charge hole angle $\alpha=90°$, if setting is made as the least resistance length W=the filler length P, excessive charge is caused to lead danger of flying rock. Accordingly, 3 powers of the filler length $(P^3)=V_2$ merely represents a nominal fracture rock volume ignoring the charge hole angle $\alpha$. Such setting may be applicable only in the case where the charge hole angle $\alpha=90°$, wherein W=P and $V_1=V_2$ can be established (see FIG. 1). In contrast to this, in case of the charge hole angle $\alpha\neq90°$ (see FIGS. 3, 4, 5), error between the nominal fracture rock volume $V_2$ and the actual fracture rock volume $V_1$ can be increased according to increasing of the charge hole angle. Therefore, danger for flying rock should be increased.

In the present invention, a ratio of the fracture rock volume $V_1=W^3$ in a range to influence for flying rock on the free surface GL on the basis of the lease resistance length W and the fracture radius D=W, and the nominal fracture rock volume $V_2=P^3$ on the basis of the filler length P and the nominal fracture radius E equal to the filler length P, namely $V_1/V_2=W^3/P^3=\sin^3\alpha$, is taken as inclination coefficient. The actual value of the inclination coefficient is variable depending upon the charge hole angle $\alpha$ as shown in the following table 1.

TABLE 1

| Charge Hole Angle $\alpha$ Relating to Free Surface GL | $\frac{\text{Least Resistance Length W}}{\text{Filler Length P}}=\sin\alpha$ | Inclination Coeffcient $=\frac{V}{V}-\frac{W}{p}=\sin^3\alpha$ |
|---|---|---|
| 90° | sin 90° = 1.000 | $(\sin 90°)^3$ = 1.000 |
| 75° | sin 75° = 0.9650 | $(\sin 75°)^3$ = 0.9011 |
| 60° | sin 60° = 0.8660 | $(\sin 60°)^3$ = 0.6495 |
| 45° | sin 45° = 0.7071 | $(\sin 45°)^3$ = 0.3535 |
| 30° | sin 30° = 0.5000 | $(\sin 30°)^3$ = 0.1250 |
| 15° | sin 15° = 0.2588 | $(\sin 15°)^3$ = 0.0173 |
| 0° | sin 0° = 0.0000 | $(\sin 0°)^3$ = 0.0000 |

Here, the fracture volume of the rock to cause danger of flying stone on the free surface is not the overall fracture volume Va to be caused by the charge length L, but is a fracture volume of the rock derived on the basis of the shortest distance between the upper end in the charge length and the free surface GL, namely the least resistance length W, in a range where Furthermore, in the present invention, with the inclination coefficient $\sin^3\alpha$ and a known blasting coefficient c=0.2 to 0.5, a nominal total fracture rock volume V $(=P^2\cdot M)$ is controlled for setting a safety charge amount L. Namely, the safety charge amount L and the nominal total fracture rock volume V has any one of the following relationship.

$$L=\sin^3\alpha\cdot c\cdot V \quad (1)$$

$$L=\sin^3\alpha\cdot c\cdot P^2\cdot M \quad (1a)$$

$$L=(W^3/P^3)\cdot c\cdot V \quad (1b)$$

$$L=(W^3/P^3)\cdot c\cdot P^2\cdot M \quad (1c).$$

These equations (1), (1a), (1b) and (1c) are relational expression for setting blasting by bar-like charge in the light of the charge hole angle α. These expressions correspond to blasting setting expression in single point concentrated charge system $L=c\cdot W^3=c\cdot V$.

Next, FIGS. 6 to 10 show a method for setting a blasting with bar-like charge with respect to two free surfaces GL1 and GL2.

In the precise meaning, the configuration which can be called as true two free surfaces blasting only when the least resistance length W extends from the upper end of the charge length N toward one free surface GL1 and, in conjunction therewith, the least resistance length W of the same length extends from the upper end of the charge length N toward the other free surface GL2. In this case, the two least resistance lengthes W1 and W2 of same length (not shown) may be present only when the charge hole interval E from the other free surface GL2 is equal to the filler length P. When the charge hole interval E is not equal to the filler length P, namely, when the charge hole length E is greater than the filler length P, it becomes one free surface blasting where least resistance length W is present only with respect to one free surface GL1. On the other hand, when the charge hole interval E is smaller than the filler length P, it becomes one free surface blasting where least resistance length W is present only with respect to the other free surface GL2. Accordingly, the configuration of the two free surfaces blasting caused only when E=P may be processed with setting as one free surface blasting.

Figure 6:
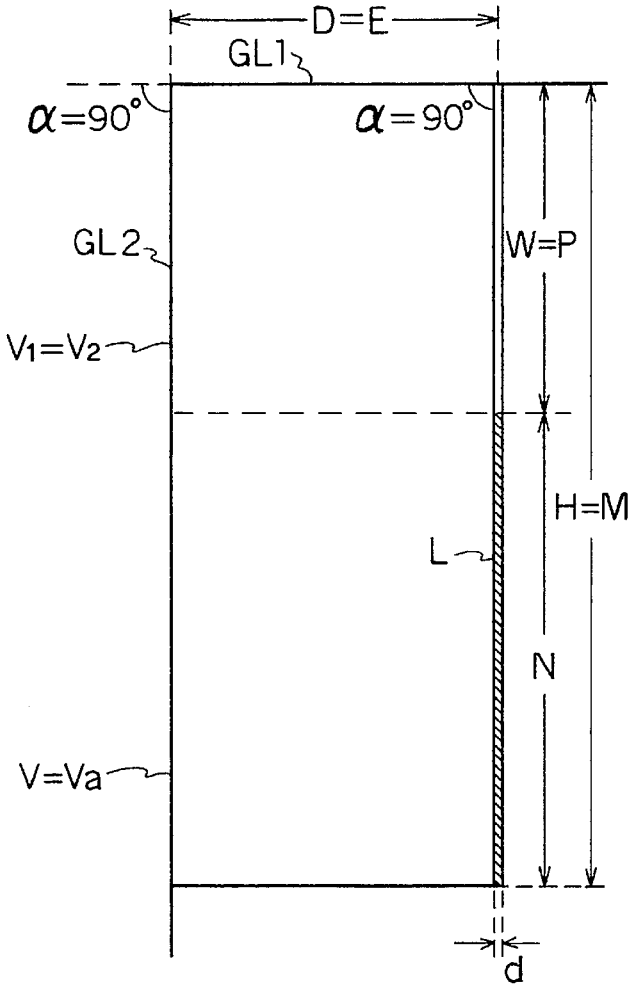
FIG. 6 is a explanatory sectional view showing relationship of various portions in blasting in bar-like charge with a charge hole angle $\alpha$=90° with relation to two free surfaces GL1 and GL2.
Figure 7:
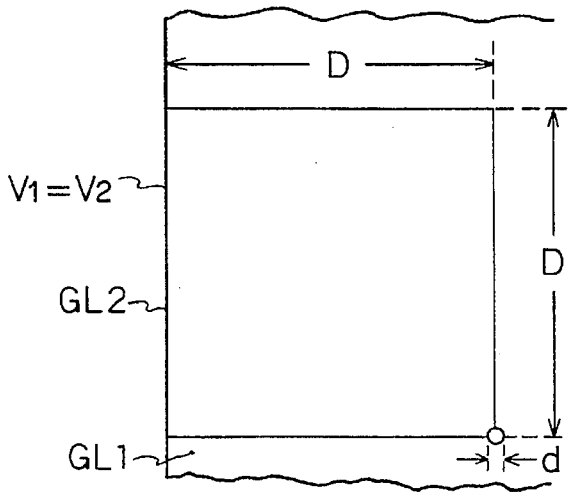
FIG. 7 is a plan view of FIG. 6
Figure 8:
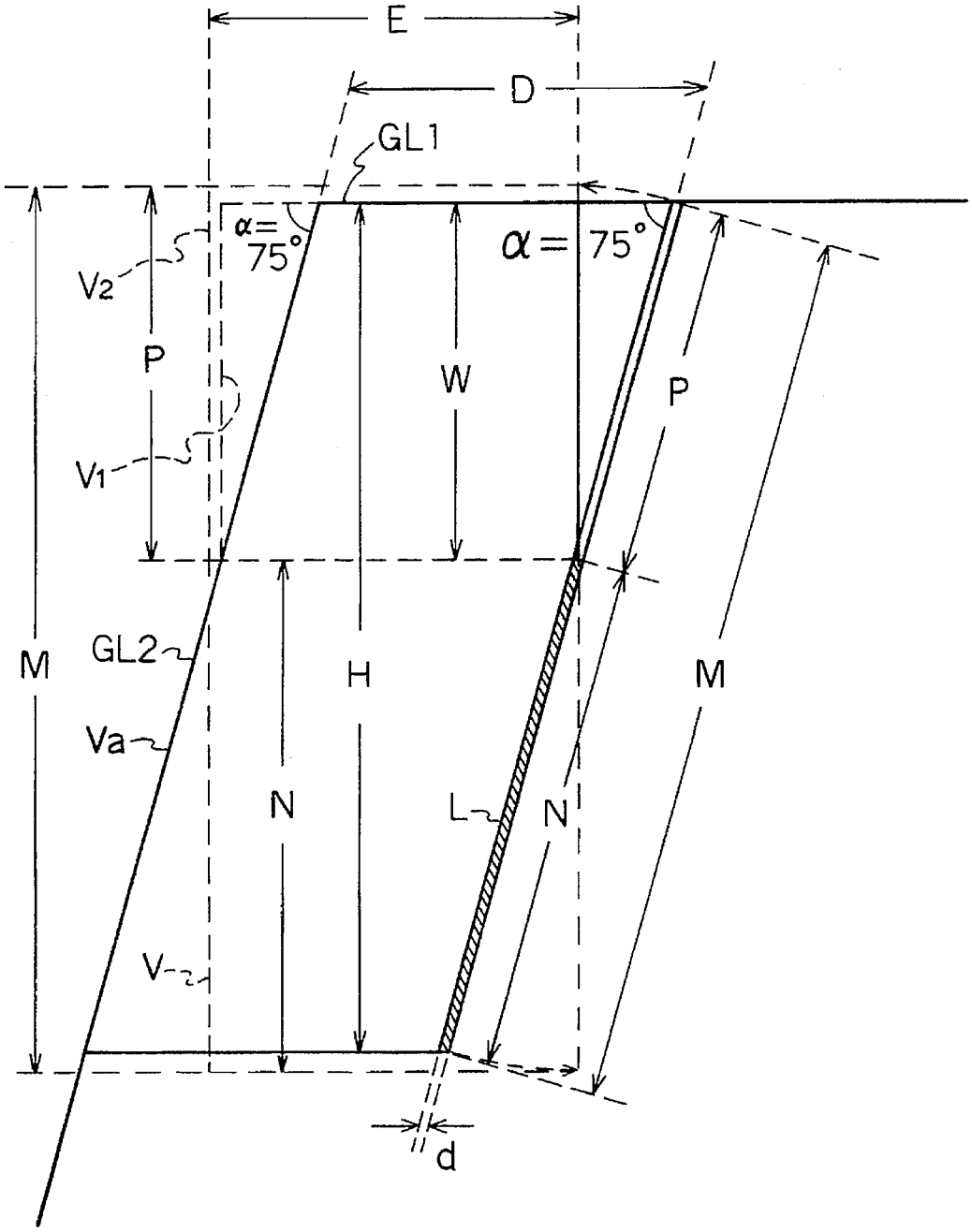
FIG. 8 is a explanatory sectional view showing relationship of various portions in blasting in bar-like charge with a charge hole angle $\alpha$=75° with relation to two free surfaces GL1 and GL2.
Figure 9:
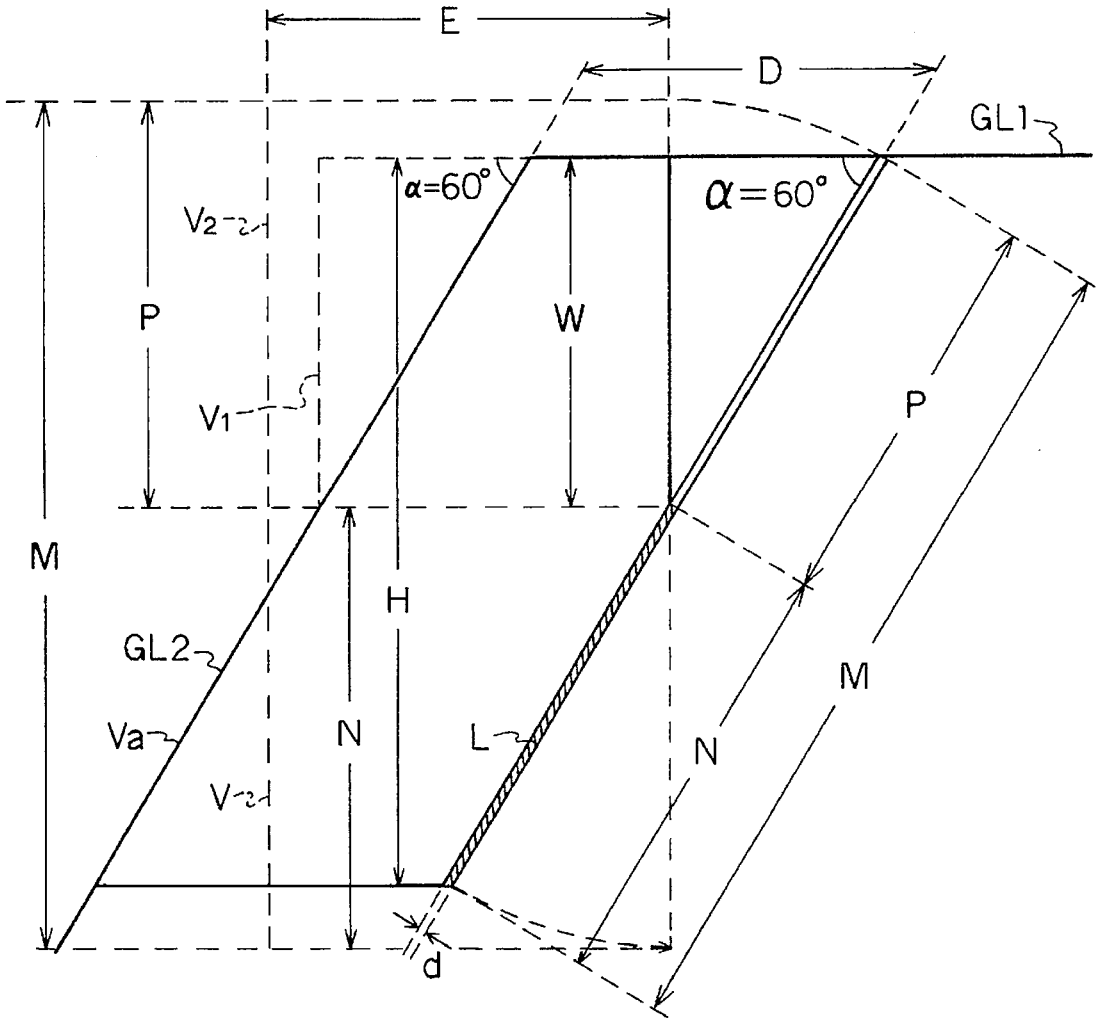
FIG. 9 is a explanatory sectional view showing relationship of various portions in blasting in bar-like charge with a charge hole angle $\alpha=60°$ with relation to two free surfaces GL1 and GL2.
Figure 10:
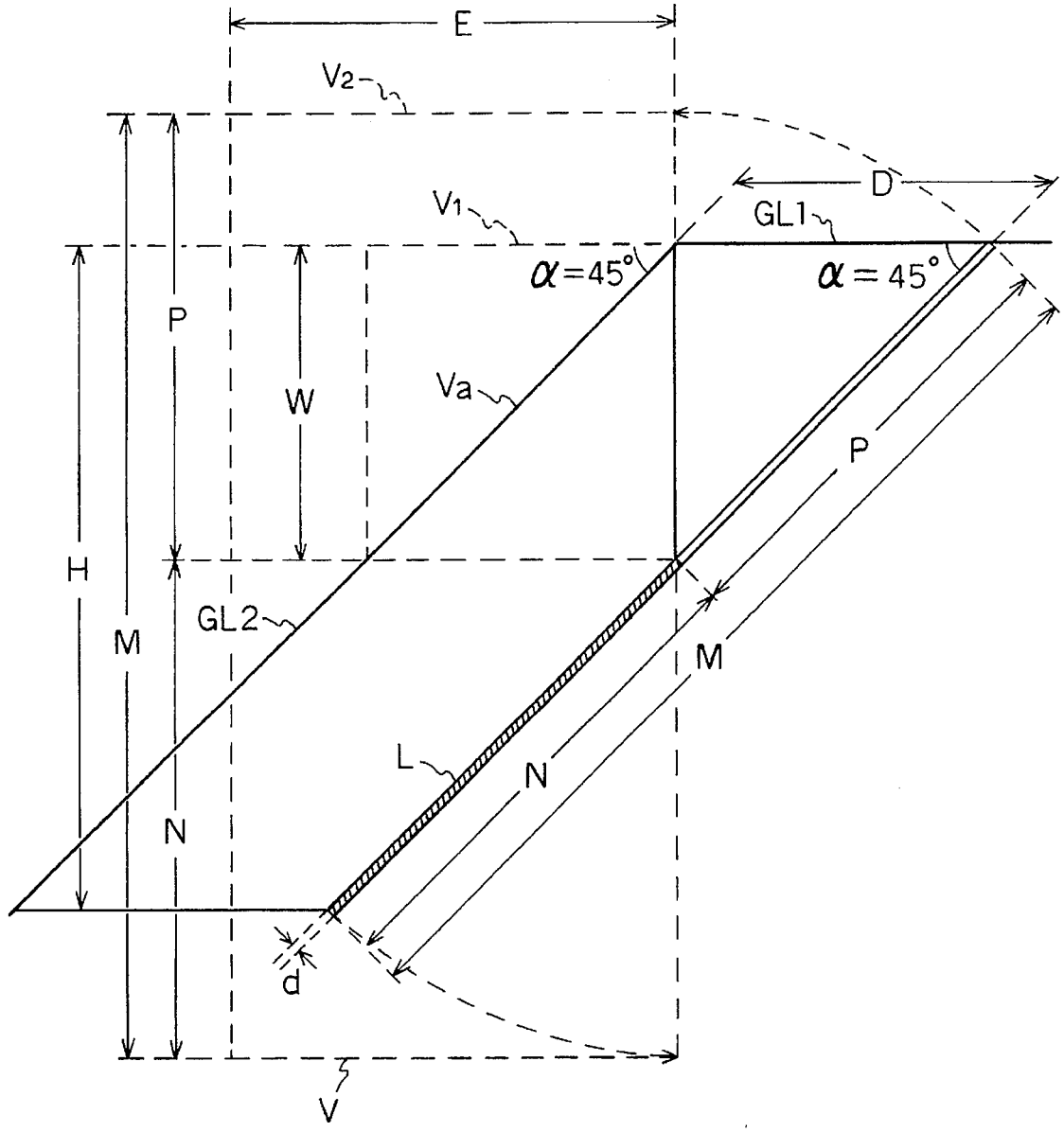
FIG. 10 is a explanatory sectional view showing relationship of various portions in blasting in bar-like charge with a charge hole angle $\alpha=45°$ with relation to two free surfaces GL1 and GL2.

According to the present invention, even when the bar-like charge to be set in the vicinity of two free surfaces, it is assumed that the charge hole angle α with respect to one free surface GL1 is set to be equal to the inclination angle α of the other free surface with respect to one free surface, and the charge hole is positioned in one free surface GL1 at a distance D from the other free surface GL2. FIG. 6 shows the case where the charge hole angle α is 90°. FIG. 8 shows the case where the charge hole angle α is 75°. FIG. 9 shows the case where the charge hole angle α is 60°. FIG. 10 shows the case where the charge hole angle α is 45°. These figures associatively show variation of constructions at respective parts associating with the charge hole angle α.

In order to facilitate understanding of the present invention, at first, the behavior in two free surfaces blasting with bar-like charge in the case where the inclination angle α of the other free surface GL2 relative to one free surface GL1 is 45° and the charge hole angle α is also 45° will be discussed.

In FIG. 10, the charge hole for bar-like charge is excavated at the charge hole angle α=45° equal to the inclination angle α=45° of the other free surface GL2 relative to one free surface GL1, the charge hole length M and the charge hole diameter d. Then, the explosive is charged in a charge amount L for a charge length N (=M−P) from the bottom of the hole. A filler is filled from the upper end of the charged explosive to one free surface GL1. The length of the filler is expressed by P. Accordingly, the overall charge hole length M is equal to the sum of the charge length N and the filler length P.

The fracture rock volume in the range to cause flying rock on one free surface GL1 is expressed as equilateral cone or cubit in one free surface while it relates to two free surfaces. Then, the fracture rock volume is not expressed as total fracture rock volume Va depending upon the charge amount L but expressed as fracture rock volume $V=W^3$ depending upon W=D on the basis of the minimum distance between the upper end of the charge length N and one free surface GL1 and a distance D between the other free surface GL2 and the charge hole.

Furthermore, since the condition of FIG. 10 is the charge hole angle α=45°, the least resistance length W is shortened with respect to the filler length P in the extent of:

$$W=\sin 45°\times P$$

Similarly to the case of blasting with bar-like charge for one free surface in the charge hole angle α=45° (see FIG. 5), the condition of FIG. 10 has higher danger of flying rock in comparison with the condition of FIG. 6 (α=90°).

In the present invention even for the blasting with bar-like charge for two free surfaces, similarly to the blasting with bar-like charge for one free surfaces, a ratio of the fracture rock volume $V_1=W^3$ in a range to cause the flying rock on one free surface GL1 and the nominal fracture rock volume $V_2=P^3$ based on the charge length P and a nominal distant length E=P, namely, $V_1/V_2=W^3/P^3=\sin^3\alpha$, as inclination coefficient, is employed. The actual value of the inclination angle is variable as the foregoing table 1 associating with the charge hole angle α.

Even in the blasting with bar-like charge for two free surfaces, similarly to the case of the blasting with bar-like charge for one free surface, the safety charge amount L can be expressed by any one of the following expressions.

$$L=\sin^3\alpha\cdot c\cdot V \quad (1)$$

$$L=\sin^3\alpha\cdot c\cdot P^2\cdot M \quad (1a)$$

$$L=(W^3/P^3)\cdot c\cdot V \quad (1b)$$

$$L=(W^3/P^3)\cdot c\cdot P^2\cdot M \quad (1c)$$

It should be noted that in FIGS. 1 to 10, the inclination coefficient $\sin^3\alpha$ can be set from the ratio of the actual total fracture rock volume $Va=\sin\alpha^3\cdot P^2\cdot M=W^2H$ and the nominal total fracture rock volume $V=P^2\cdot M$, namely, $\sin^3\alpha=Va/V=((W^2H)/(P^2M))$, as alternative of $V_1/V_2=W^3/P^3$ set forth above.

In the case of charge hole angle α of the charge hole excavated from the free surface GL relative to the free surface GL is 90°, the safety charge amount L is:

$$L=c\cdot P^2\cdot M \quad (1bb)$$

On the other hand, in the case of α=90°, vertical length H from the lower end of the charge length N relative to the free surface GL is equal to the charge hole length M, and the charge length P and the least resistance length W are equal to each other. Therefore, the safety charge length L can be set by:

$$L=c\cdot W^2\cdot H \quad (1bbb)$$

When one free surface GL1 and the other free surface GL2 are present, the charge hole is excavated from one free surface GL1 and the relationship between the nominal distance E from the other free surface GL2 and the filler length P is P<E, the configuration of the blasting becomes one free surface blasting having the least resistance length W relative to one free surface GL1.

When one free surface GL1 and the other free surface GL2 are present, the charge hole is excavated from one free surface GL1 and the relationship between the nominal distance E from the other free surface GL2 and the filler length P is P>E, the configuration of the blasting becomes one free surface blasting having the least resistance length W relative to one free surface GL2.

Next, detailed discussed will be given hereinafter for a method to derive the charge hole diameter d as inherent factor for setting blasting with bar-like charge.

In FIGS. 1 to 10, the charge amount L is an amount corresponding a volume of circular column body having the charge hole diameter d, the charge length N=M−P, and thus can be set by the following relational expression:

$$L=(\pi/4)d^2(M-P)A \quad (2)$$

In the present invention, by combining the relational expression (2) and the setting equation of the safety charge amount as expressed by (1), (1a), (1b) and (1c), the following relational expressions are established.

$$\sin^3\alpha\cdot c\cdot V=(\pi/4)d^2(M-P)A \quad (3)$$

$$\sin^3\alpha\cdot c\cdot P^2\cdot M=(\pi/4)d^2(M-P)A \quad (3a)$$

$$(W^3/P^3)\cdot c\cdot V=(\pi/4)d^2(M-P)A \quad (3b)$$

$$(W^3/P^3)\cdot c\cdot P^2\cdot M=(\pi/4)d^2(M-P)A \quad (3c).$$

Then, from the foregoing expression (3a), the charge hole diameter d can be expressed by:

$$d=\sqrt{((4\sin^3\alpha\cdot c\cdot P^2\cdot M)/(\pi(M-P)A))} \quad (4)$$

Replacing (1a) in the expression (4), it can be set $$d=\sqrt{((4L)/(\pi(M-P)A))} \quad (4a)$$

The charge length P can be set with the expression of the foregoing (3a) and (3b):

$$P=\frac{-\frac{\pi}{4}d^2A+\sqrt{\left[\frac{\pi}{4}d^2A\right]^2+\pi d^2\cdot\sin^3\alpha\cdot c\cdot AM^2}}{2\sin\alpha^3\cdot c\cdot M} \quad (5)$$

$$P=\frac{-\frac{\pi}{4}d^2A+\sqrt{\left[\frac{\pi}{4}d^2A\right]^2+\pi d^2\cdot\left(\frac{W^3}{P^3}\right)\cdot c\cdot AM^2}}{2\cdot\left(\frac{W^3}{P^3}\right)\cdot c\cdot M} \quad (5a)$$

Furthermore, the charge length N=M−P can be expressed from the foregoing (4):

$$N=(4\sin^3\alpha\cdot c\cdot P^2\cdot M)/(\pi d^2A) \quad (6)$$

On the other hand, from the equation (4a), the charge length can be expressed as:

$$N=(4L)/(\pi d^2A) \quad (6a)$$

EXAMPLE

At first, an example for setting the charge hole diameter d will be discussed hereinafter.

In case of the charge hole, having the charge hole angle α=70° relative to one free surface, the charge hole length M=1600 cm, the filler length P=752 cm, blasting coefficient c=0.000294, specific weight of explosive A=0.83:

inclination coefficient $(\sin 70°)^3=0.93973=0.8298$;
charge amount $L=\sin^3\alpha\cdot c\cdot P^2\cdot M=0.8298\times0.000294\times752.322\times1600=220922.74$ (g)

Accordingly, the charge hole diameter d can be $$d=\sqrt{((4\sin^3\alpha\cdot c\cdot P^2\cdot M)/(\pi(M-P)A))}\approx 20\text{ cm}$$

Next, when the charge hole diameter d=20 cm, the charge hole length M=1600 cm, the charge hole angle α=90°, the blasting coefficient c=0.000294 and the specific weight of the explosive A=0.83, inclination coefficient $(\sin 90°)^3=1.0000$;

$$\text{charge amount}=\sin^3\alpha\cdot c\cdot P^2\cdot M=1\times0.000294\times704.41^2\times1600=233408.87\text{ (g)}$$

Thus, from the foregoing equation (5), the filler length P=704.4 cm.

The least resistance length W $W=P\times\sin 90°=704.4$ *cm*

Fracture diameter D on the free surface GL is

D=W=704.4 cm

The vertical height H with respect to the free surface GL from the lower end of the charge length N is $H=\sin 90°\times M=1600$ *cm*

The charge length N is $N=M-P=1600-704.4=895.6$ *cm*

The charge amount L is, from the foregoing equation (1a), $L=\sin^3\alpha\cdot c\cdot P^2\cdot M=1\times0.000294\times704.4^2\times1600\doteq233400$ (g)

Alternative the above, from the foregoing equation (2), the charge amount L $$L=(\pi/4)d^2(M-P)A=(3.14/4)\times20^2\times(1600-704.4)\times0.83\approx233400\text{ (g)}$$

Next, when the charge hole diameter d=20 cm, the charge hole length M=1600 cm, the charge hole angle α=70°, the blasting coefficient c=0.000294 and the specific weight of the explosive A=0.83, inclination coefficient $(\sin 70°)^3=0.9397^3=0.8298$; charge amount=$\sin^3\alpha\cdot c\cdot P^2\cdot M=220900$ +tm (g)

The filler length is

P=752.3 cm.

The least resistance length W $W=\sin 70° \times P=0.9397 \times 752.3=706.9\ cm$ Fracture diameter D on the free surface GL is $D=W=706.9$ cm The vertical height H with respect to the free surface GL from the lower end of the charge length N is $H=\sin 70° \times M=0.9397 \times 1600=1503.5$ cm The charge length N is $N=M-P=1600-752.3=847.7\ cm$ The charge amount L is, from the foregoing equation (1a), $$L = \sin^3\alpha \cdot c \cdot P^2 \cdot M = 0.8298 \times 0.000294 \times 752.3^2 \times 1600 \approx 220900\ (g)$$

Alternative the above, from the foregoing equation (2), the charge amount L $$L=(\pi/4)d^2(M-P)A=(3.14/4)\times 20^2\times(1600-752.3)\times 0.83 \doteq 220900\ (g)$$

Next, when the charge hole diameter d=20 cm, the charge hole length M=1600 cm, the charge hole angle $\alpha=45°$, the blasting coefficient c=0.000294 and the specific weight of the explosive A=0.83, inclination coefficient $(\sin 45°)^3=0.70713=0.35354$;

$$\text{charge amount} = \sin^3\alpha \cdot c \cdot P^2 \cdot M = 0.35354 \times 0.000294 \times 983.2^2 \times 1600 \approx 160800\ (g)$$

Thus, from the foregoing equation (5), the filler length

P=983.2 cm.

The least resistance length W $W=P \times \sin 45°=695.2$ cm

Fracture diameter D on the free surface GL is

D=W=695.2 cm

The vertical height H with respect to the free surface GL from the lower end of the charge length N is $H=\sin 45° \times M=0.7071 \times 1600=1131.36 cm$ The charge length N is $N=M-P=1600-983.2=616.8\ cm$ The charge amount L is, from the foregoing equation (1a), $$L = \sin^3\alpha \cdot c \cdot P^2 \cdot M = 0.35354 \times 0.000294 \times 983.2^2 \times 1600 \approx 160800\ (g)$$

Alternative the above, from the equation (2), the charge amount L $$L = (\pi/4)d^2(M-P)A = (3.14/4) \times 20^2 \times (1600-983.2) \times 0.83 \approx 160800\ (g)$$

As set forth above, upon setting blasting with bar-like charge, in improvement of setting based on the conventional single point concentrated charge system, the charge hole angle $\alpha$ relative to the free surface GL which is specific to the bar-like charge, as a factor for setting. In addition, on the basis of the charge hole angle $\alpha$, the inclination coefficient $V_1/V_2=W^3/P^3=\sin^3\alpha$ is established. Then, the safety charge amount L is derived on the basis of the inclination coefficient and the known blasting coefficient c through the safety charge amount $L=\sin^3\alpha \cdot c \cdot P^2 \cdot M$ (P is the filler length and M is the charge hole length) to incorporate the factor of magnitude of destructive power to be caused on the free surface, which is a factor to cause accident of flying rock. Therefore, the blasting with bar-like charge can be safely set with possible maximum efficiency with avoiding possibility of causing flying rock.

Furthermore, according to the present invention, the charge hole diameter d which has not been able to be derived from the relational equation for setting the well known blasting, by coupling the foregoing equation for setting $L=\sin^3\alpha \cdot c \cdot P^2 \cdot M$ and $L=(\pi/4)d2 \cdot (M-P)A$ and the equation for deriving a volume of circular column body for setting $L=(\pi/4)d^2(M-P)A$ can be set accurately, by associating with other factors, i.e. the charge hole length M, the least resistance length W, the filler length P, the charge length N=M−P, charge amount L, the blasting coefficient c, the fracture radius or interval length D, the inclination coefficient $\sin^3\alpha$are taken into consideration for accurate setting. Thus, Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A method for setting blasting with bar-like charge, for which excavate a charge hole into ground from a free surface comprising the steps of:

deriving a fracture rock volume $V_1=W^3$ in a range influencing for flying rock on said free surface GL with taking a charge hole angle relative to said free surface GL in excavation of said charge hole from said free surface GL as $\alpha$, a charge hole length as M, a charge length as N=M−P, a filler length as P, with taking a least resistance length W as shortest distance between the upper end of the charge length N and said free surface GL, making a fracture radius D caused on said free surface equal to said least resistance length W, and on the basis of said least resistance length W and said fracture length D=W;

deriving a nominal fracture rock volume $V_2=P^3$ on the basis of said filler length P and a nominal fracture radius E equal to said filler length P;

deriving an inclination coefficient $\sin^3\alpha(=V_1/V_2=W^3/P^3)$ based on a ratio between said fracture rock volume $V_1=W^3$ and said nominal fracture rock volume $V_2=P^3$; and deriving a safety charge amount L by controlling a nominal total fracture rock volume $V=P^2 \cdot M$ with said inclination coefficient $\sin^3\alpha$ and a blasting coefficient c=0.2 to 0.5, by one of $$L=\sin^3\alpha\cdot c\cdot V \quad (1)$$

$$L=\sin^3\alpha\cdot c\cdot P^2\cdot M \quad (1a)$$

$$L=(W^3/P^3)\cdot c\cdot V \quad (1b)$$

$$L=(W^3/P^3)\cdot c\cdot P^2\cdot M \quad (1c).$$

2. A method as set forth in claim 1, wherein said fracture radius D is a charge hole interval D.

3. A method for setting blasting with bar-like charge, for which excavate a charge hole to ground having two free surfaces, in which the other free surface GL2 being oriented at an inclination angle α relative to one free surface GL1, comprising the steps of:

deriving a fracture rock volume $V_1=W^3$ in a range influencing for flying rock on said one free surface GL1 with taking said charge hole angle relative to said one free surface GL1 in excavation of said charge hole from said one free surface GL1 as α, a charge hole length as M, a charge length as N=M−P, a filler length as P, with taking a least resistance length W as shortest distance between the upper end of the charge length N and said one free surface GL1, making a fracture radius D between said other free surface GL2 and said charge hole equal to said least resistance length W, and on the basis of said least resistance length W and said fracture length D=W;

deriving a nominal fracture rock volume $V_2=P^3$ on the basis of said filler length P and a nominal fracture radius E equal to said filler length P;

deriving an inclination coefficient $\sin^3\alpha$ $(=V_1/V_2=W^3/P^3)$ based on a ratio between said fracture rock volume $V_1=W^3$ and said nominal fracture rock volume $V_2=P^3$; and deriving a safety charge amount L by controlling a nominal total fracture rock volume $V=P^2\cdot M$ with said inclination coefficient $\sin^3\alpha$ and a blasting coefficient c=0.2 to 0.5, by one of $$L=\sin^3\alpha\cdot c\cdot V \quad (1)$$

$$L=\sin^3\alpha\cdot c\cdot P^2\cdot M \quad (1a)$$

$$L=(W^3/P^3)\cdot c\cdot V \quad (1b)$$

$$L=(W^3/P^3)\cdot c\cdot P^2\cdot M \quad (1c).$$

4. A method as set forth in claim 1 or 3, wherein said inclination coefficient $\sin^3\alpha$ is a ratio of actual total fracture rock volume $Va=\sin^3\alpha\cdot P^2\cdot M$ and a nominal total fracture rock volume $V=P^2\cdot M$, namely $Va/V=\sin^3\alpha$.

5. A method as set forth in claim 1 or 3, wherein when charge hole angle α relative to said free surface GL of said charge hole excavated from said free surface GL being 90°, said safety charge amount L is $$L=c\cdot P^2\cdot M \quad (1bb)$$

or, when said α is 90°, a vertical length H from the lower end of said charge length N to said free surface GL is equal to said charge hole length M, and said filler length P and said least resistance length W are equal to each other, said safety charge amount L is $$L=c\cdot W^2\cdot H \quad (1bbb).$$

6. A method as set forth in claim 3, wherein when said one free surface GL1 and the other free surface GL2 are present, said charge hole is excavated from said one free surface GL1, and when a nominal length E from the other free surface GL2 and said filler length P is P<E, the blasting becomes a configuration of one free surface blasting having the least resistance length W relative to said one free surface GL1.

7. A method as set forth in claim 3, wherein when said one free surface GL1 and the other free surface GL2 are present, said charge hole is excavated from said one free surface GL1, and when a nominal length E from the other free surface GL2 and said filler length P is P>E, the blasting becomes a configuration of one free surface blasting having the least resistance length W relative to said one free surface GL2.

8. A method as set forth in claim 1 or 3, wherein, utilizing an equation for deriving a volume of a circular column in consideration of the fact that the charge amount L in bar-like charge is an amount corresponding to the volume of the circular column based on the charge hole diameter d and the charge length N=M−P for establishing setting with combining the charge hole diameter d which is inherent factor in bar-like charge with other factors, the charge amount L is derived by:

$$L=(\pi/4)d^2(M-P)\cdot A \quad (2)$$

wherein A is a specific wave of a charged explosive, and by coupling said relational expression with the equations for deriving said safety charge amount of $$L=\sin^3\alpha\cdot c\cdot V \quad (1)$$

$$L=\sin^3\alpha\cdot c\cdot P^2\cdot M \quad (1a)$$

$$L=(W^3/P^3)\cdot c\cdot V \quad (1b)$$

$$L=(W^3/P^3)\cdot c\cdot P^2\cdot M \quad (1c),$$

to establish $$\sin^3\alpha\cdot c\cdot V=(\pi/4)d^2(M-P)A \quad (3)$$

$$\sin^3\alpha\cdot c\cdot P^2\cdot M=(\pi/4)d^2(M-P)A \quad (3a)$$

$$(W^3/P^3)\cdot c\cdot V=(\pi/4)d^2(M-P)A \quad (3b)$$

$$(W^3/P^3)\cdot c\cdot P^2\cdot M=(\pi/4)d^2(M-P)A \quad (3c).$$

9. A method as set forth in claim 8, wherein said charge hole diameter is derived from the equation (3a) as $$d=\sqrt{((4\sin^3\alpha\cdot c\cdot P^2\cdot M)/(\pi(M-P)A))} \quad (4)$$

or by replacing the (1a) in the equation (4) as $$d=\sqrt{((4L)/(\pi(M-P)A))}\ . \quad (4a)$$

10. A method as set forth in claim 8, wherein said filler length P is derived from the following equations modified from (3a) or (3b) as:

$$P=\frac{-\frac{\pi}{4}d^2A+\sqrt{\left[\frac{\pi}{4}d^2A\right]^2+\pi d^2\cdot\sin^3\alpha\cdot c\cdot AM^2}}{2\sin^3\alpha\cdot c\cdot M} \quad (5)$$

or $$P=\frac{-\frac{\pi}{4}d^2A+\sqrt{\left[\frac{\pi}{4}d^2A\right]^2+\pi d^2\cdot\left(\frac{W^3}{P^3}\right)\cdot c\cdot AM^2}}{2\cdot\left(\frac{W^3}{P^3}\right)\cdot c\cdot M}. \quad (5a)$$

11. A method as set forth in claim 8, wherein the charge length N=M−P is expressed from the foregoing (4):

$$N=(4\sin^3\alpha\cdot c\cdot P^2\cdot M)/(\pi d^2A) \quad (6)$$

or from the equation (4a), $$N=(4L)/(\pi d^2A) \quad (6a).$$

* * * * *

UNITED STATES PATENT AND TRADEMARK OFFICE

CERTIFICATE OF CORRECTION

PATENT NO. : 5,650,588

DATED : July 22, 1997

INVENTOR(S) : Yasuji Nakajima

It is certified that error appears in the above-identified patent and that said Letters Patent is hereby corrected as shown below:

On the title page item [57],

Abstract Line 5 "facter" should be -- factors --

Column 6, Line 23 "xpressed" should be -- expressed --

Column 10, Line 44 "$Va=\sin\alpha^3.p^2$. $M=W^2H$" should be --$Va=\sin^3\alpha.p^2$. $M=W^2H$ --

Column 11, Line 48 "$2\sin\alpha^3$. c. M"" should be -- $2\sin^3\alpha$. c. M --

Column 12, Line 61 "220900 + tm (g) " should be -- 220900 (g) --

Signed and Sealed this

Third Day of February, 1998

*Attest:*

*Attesting Officer*

BRUCE LEHMAN

*Commissioner of Patents and Trademarks*